United States Patent [19]

Caradonna

[11] 4,380,839

[45] Apr. 26, 1983

[54] GOLF IRON WASHER

[76] Inventor: Charles Caradonna, 260 Woodside Ct., Apt. 228, Rochester, Mich. 48063

[21] Appl. No.: 278,211

[22] Filed: Jun. 29, 1981

[51] Int. Cl.[3] ..... A63B 57/00

[52] U.S. Cl. ..... 15/104.92; 15/21 B; 15/160

[58] Field of Search ..... 15/104.92, 21 R, 21 A, 15/21 B, 21 C, 21 D, 97 R, 39, 160, 210 B, 218.1

[56] References Cited

U.S. PATENT DOCUMENTS

| | | | |
|---|---|---|---|
| 110,959 | 1/1871 | Darling | 15/104.92 |
| 2,617,132 | 11/1952 | Goller | 15/160 X |
| 2,744,276 | 5/1952 | Chambless | 15/104.92 |
| 2,807,037 | 9/1957 | Garske | 15/21 A |
| 3,224,029 | 12/1965 | Domingos | 15/104.92 |
| 3,304,659 | 2/1967 | Eichhorn | 15/21 A |
| 3,428,988 | 2/1969 | Blackburn | 15/104.92 |
| 3,748,676 | 7/1973 | Warren et al. | 15/21 A |

*Primary Examiner*—Edward L. Roberts
*Attorney, Agent, or Firm*—Robert G. Mentag

[57] ABSTRACT

A golf iron washer including a housing that has a bottom wall, a pair of integral front and rear vertical walls, and a pair of integral side vertical walls, and which is open at the upper end thereof. The housing has cleaning member support means for supporting a pair of cleaning members disposed on their sides with their cleaning elements extended toward each other in opposing relationship. A cover member is releasably mounted on the upper open end of said housing and it has an opening formed therethrough for the passage therethrough of a golf iron. A predetermined level of cleaning fluid is disposed in said housing. The cover member is provided with inwardly extended integral guide walls which have their lower ends in abutting engagement with the cleaning members for releasably retaining them in the cleaning member support means, whereby when a golf iron is manually inserted head first through the opening in said cover member the golf iron head is guided by the guide walls between said cleaning members, and continued manual reciprocating of the golf iron results in a washing of the golf iron head.

8 Claims, 6 Drawing Figures

GOLF IRON WASHER

TECHNICAL FIELD

This invention relates generally to the golf art, and more particularly to an improved golf iron washer. The golf iron washer of the present invention is adapted for use as either a portable, free standing model with its own cast iron stand, or as a stationary model with a steel post that can be installed in the ground at any desired location on the golf course as, for example, at a tee or in other positions around a golf course.

BACKGROUND ART

It is known in the golf art to provide golf club head washer apparatuses. Heretofore, the prior art golf club head washer apparatuses employed movable brush means as, for example, a rotating brush means or a brush reciprocating over the face of a club head. Examples of prior art golf club head washer apparatuses of the type employing rotary brushes are illustrated in U.S. Pat. Nos. 3,148,396; 3,748,676; 3,872,534; and 3,950,810. An example of a golf club washer employing a cavity for holding a golf head and a reciprocating brush for brushing the face of the club is illustrated in U.S. Pat. No. 3,400,416. A disadvantage of the aforementioned golf club washer prior art apparatuses is that they employ many moving parts, and they are expensive and require a great deal of maintenance to keep them in operating condition.

DISCLOSURE OF THE INVENTION

In accordance with the present invention, a golf iron washer is provided which can be employed as a portable or as a stationary washer apparatus. The golf iron washer of the present invention comprises a rectangular receptacle for containing a cleaning or washing liquid. A pair of stationary cleaning members, such as brushes or pads are operatively mounted in the receptacle housing, in opposing positions, with the free end of one cleaning member being disposed adjacent the free end of the other cleaning member. An opening is formed in the upper end of the receptacle housing to permit the dirty blade of a golf iron to be moved vertically downwardly between the opposed cleaning members which are disposed in the washing liquid, whereby the golf iron blade can be cleaned by reciprocating the golf iron upwardly and downwardly. The washer apparatus may be used as a portable, free standing model with a cast iron stand, or as a stationary model with a steel post that can be installed in the ground. The golf iron washer of the present invention may be employed at a golf tee, or along the fairway as a 150 yard marker or the like.

The golf iron washer apparatus of the present invention is simple in structure and economical to make. It is preferably made from a tough, durable plastic construction, and it is easy to maintain.

BEST MODE OF CARRYING OUT THE INVENTION

Figure 1:
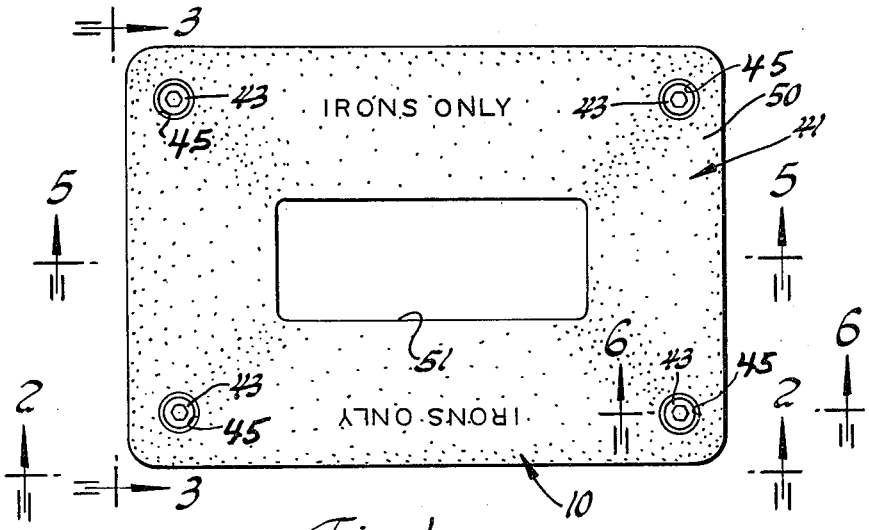
FIG. 1 is a top plan view of a golf iron washer made in accordance with the principles of the present invention.
Figure 2:
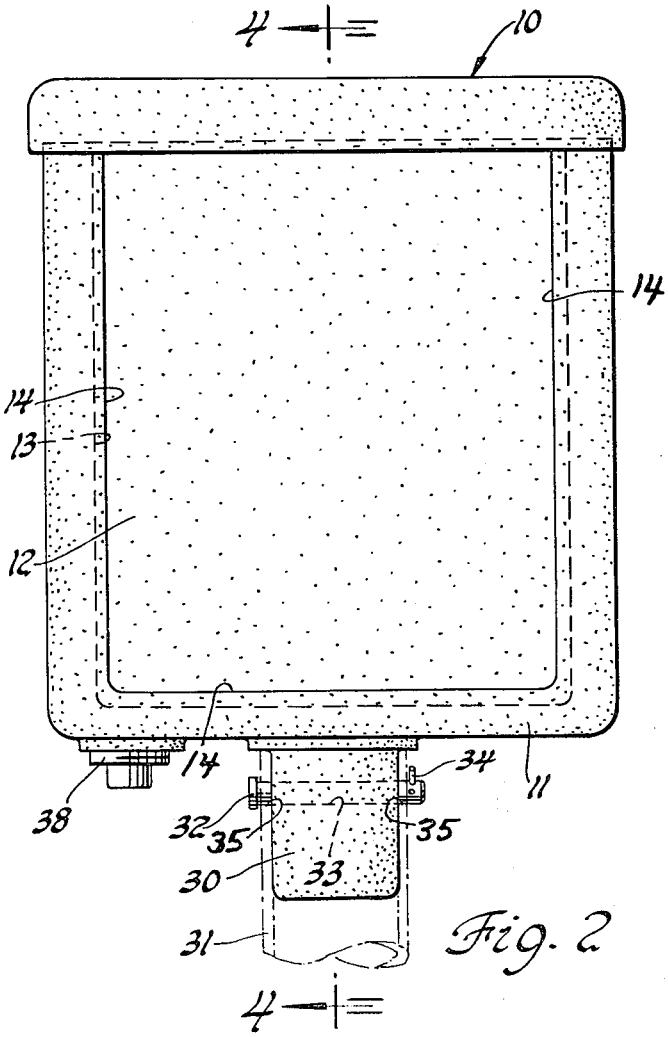
FIG. 2 is a front elevation view of the golf iron washer structure illustrated in FIG. 1, taken along the line 2—2 thereof, and looking in the direction of the arrows.
Figure 3:
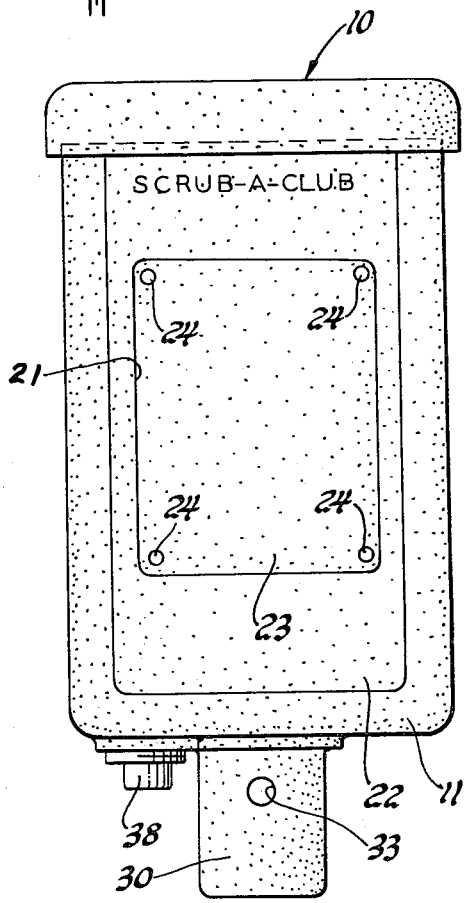
FIG. 3 is a left side elevation view of the golf iron washer structure illustrated in FIG. 1, taken along the line 3—3 thereof, and looking in the direction of the arrows.

Referring now to the drawings, and in particular to FIGS. 1, 2 and 3, the numeral 10 generally designates an illustrative embodiment of a golf iron washer made in accordance with the principles of the present invention. The golf iron washer 10 comprises a rectangular receptacle having a housing which includes a horizontal bottom end wall 11, an integral vertical front wall 12, an integral vertical rear wall 15, and a pair of integral vertical side walls 22 and 27. The rectangular receptacle housing may be made form any suitable material as, for example, a suitable molded plastic material, as a one-quarter inch thick automotive strength resin plastic material.

Figure 4:
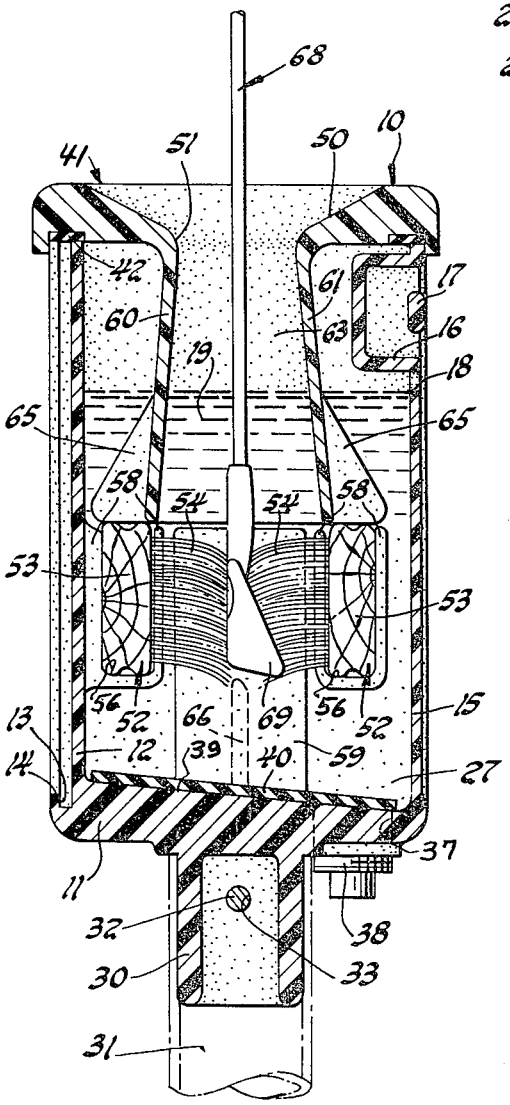
FIG. 4 is an elevation section view of the golf iron washer structure illustrated in FIG. 2, taken along the line 4—4 thereof, and looking in the direction of the arrows.

As illustrated in FIGS. 2 and 4, the front vertical wall 12 has a rectangular recess 13 formed in the outer surface thereof, which is bounded along the bottom and two sides with integral flanges 14. It will be understood that the last described structure comprises a receptacle for an advertising board. An advertising board, such as a sheet of plastic, sheet metal or the like may be slidably mounted in the recess 13, from the upper end thereof, and may include advertising matter on the outer surface thereof.

Figure 5:
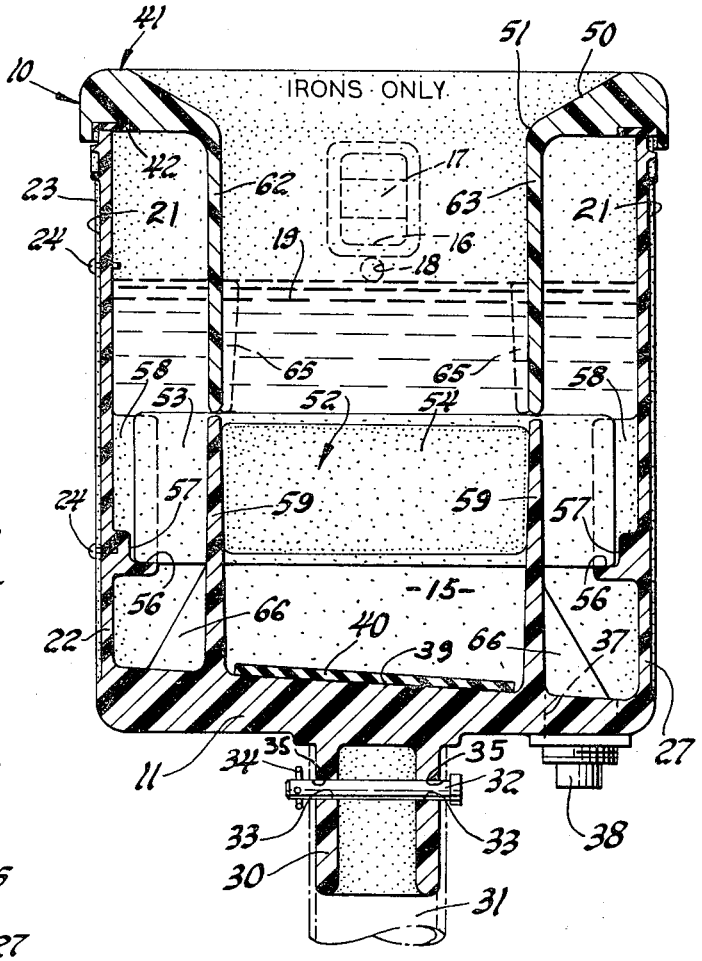
FIG. 5 is an elevation section view of the golf iron washer structure illustrated in FIG. 1, taken along the line 5—5 thereof, and looking in the direction of the arrows.

As shown in FIGS. 4 and 5, the receptacle housing of the golf iron washer 10 is provided with a towel bar 17 that is formed across the outer face of a rectangular recess 16 that is formed in the upper end of the rear vertical wall 15, adjacent the upper end thereof.

As shown in FIGS. 4 and 5, the golf iron washer housing is provided with a suitable drain hole 18 that is formed through the rear wall 15, at a point below the towel recess 16. The numeral 19 designates a suitable washing or cleaning fluid in the golf iron washer housing, and the maximum level of the washing or cleaning fluid 19 is maintained by the drain hole 18. The drain hole 18 maintains the maximum level of fluid in the golf iron washer housing due to any addition to the fluid because of rain entering the housing.

As shown in FIGS. 3 and 5, the one side wall 22 is provided with a rectangular recess 21 in which is adapted to be seated an instruction plaque 23. The plaque 23 is held in position by suitable drive pins 24. As shown in FIG. 5, the other side wall 27 may also be provided with a similar recess 21 for the mounting therein of a second instruction plaque or the like, if desired.

As shown in FIGS. 2 through 5, the golf iron washer housing is provided on the lower outer face of the bottom end wall 11 with an integral mounting tube 30 that is made out of the same material as the other parts of the washer 10. The mounting tube 30 is adapted to be slidably mounted in the upper end of a suitable pipe stand 31 as, for example, a two inch pipe. The upper end of the pipe stand 31 would be releasably secured to the mounting tube 30 by a suitable clevis pin 32, which is adapted to pass through a horizontal bore 33 formed through the mounting tube 30 and a pair of aligned bores 35 (FIG. 5) in the pipe 31. The clevis pin 32 is secured in position by a suitable cotter pin 34.

As shown in FIGS. 4 and 5, the inner upper surface of the housing bottom end wall 11 is angled or sloped toward the side wall 27, as indicated by the numeral 39. The angled bottom end surface 39 functions to direct the cleaning fluid 19 towards a threaded drain hole 37 when it is desired to drain all fluid from the golf iron washer 10. The drain hole 37 is normally closed by a threadably mounted drain plug 38.

A rectangular cushion pad 40 is seated centrally on the sloping surface 39 of the bottom end wall 11 in a position to stop the downward movement of a golf iron when it is moved into the washer apparatus too far, and to cushion the stopping movement of the golf iron.

Figure 6:
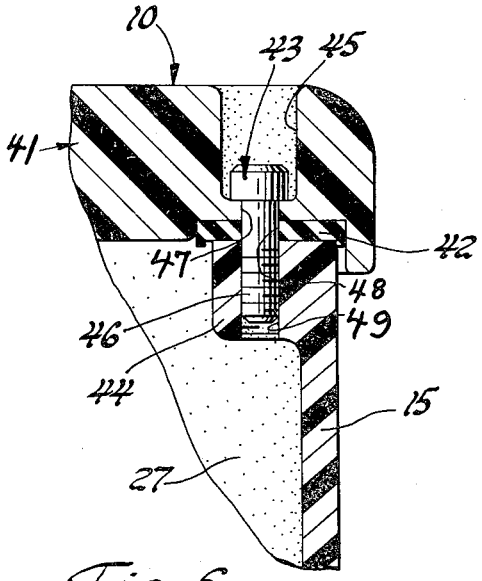
FIG. 6 is a fragmentary, enlarged, elevation section view of the golf iron washer structure illustrated in FIG. 1, taken along the line 6—6 thereof, and looking in the direction of the arrows.

The numeral 41 generally designates a releasably mounted cover which is molded from the same plastic material as employed in forming the aforedescribed washer housing. The cover 41 is rectangular in overall shape, and it is seated on the top ends of the receptacle housing walls 12, 15, 22 and 27. A suitable gasket 42 is mounted between the contacting surfaces of the cover 41 and the upper ends of the last mentioned housing walls. As illustrated in FIG. 6, an integral boss 44 is formed at each of the upper end corners of the washer housing. As shown in FIG. 1, the cover 41 has a counterbore 44 formed inwardly from the upper surface thereof, at each corner thereof, into a position over the adjacent boss 44. The cover 41 is secured to the bosses 44 by suitable screws, generally indicated by the numeral 43. Each of the screws 43 has its head positioned in one of the counterbores 45 and its threaded shaft 46 extended through a bore 47 in the cover 41, and through a mating bore 48 in the gasket 42, and into threaded engagement with a threaded bore 49 in the adjacent boss 44.

As shown in FIGS. 4 and 5, the cover 41 has a top outer end surface 50 which slopes inwardly and downwardly toward a central rectangular opening 51.

The cover 41 has integrally formed around the opening 51 on the inner side thereof, a pair of vertical, inwardly extended side guide walls 62 and 63, which are parallel with the side walls 22 and 27. The cover 41 also has a pair of inwardly extended front and rear guide walls 60 and 61 which extend inwardly toward a pair of cleaning members illustrated as brushes 52. The guide walls 60 and 61 slope inwardly and outwardly toward the adjacent front wall 12 and rear wall 15, respectively. The guide walls 60 through 63 are all integrally joined. The guide walls 60 and 61 each carry an integrally formed, vertical cleaning member retainer plate 65 which extends outwardly from the lower end of the walls 60 and 61, toward the front and rear walls 12 and 15. The cleaning member retainer plates 65 are each adapted to seat against one side edge of one of the cleaning member carrier heads 53 of the pair of cleaing brushes 52, and they are mounted as shown in FIGS. 4 and 5.

As shown in FIGS. 4 and 5, each of the cleaning member brushes 52 includes a rectangular, block-shaped carrier head 53 which is made from a suitable material, such as wood, plastic or the like, and which carries a plurality of conventional bristles 54. As best seen in FIG. 4, the two brushes 52 are disposed so that the free ends of the bristles 54 are adjacent each other, and in opposing relationship to each other. As shown in FIG. 5, the carrier head 53 of each of the brushes 52 extends longitudinally outward beyond the ends of the bristles 54, and they are slidably mounted in a pair of U-shaped cleaning member holders formed by a pair of vertical, laterally spaced apart walls 58 and an integral bottom wall 56. The walls 56 and 58 are integrally attached to the inner face of the side walls 22 and 27, in positions immediately below the lower ends of the guide walls 60 through 63, so that when the brushes 52 are in the position shown in FIG. 4, the lower ends of the cleaning member retainer plates 65 engage the upper side of each of the cleaning member carrier heads 53 and exert a retaining pressure downwardly downwardly to hold the cleaning members or brushes 52 in place in their U-shaped cleaning member holders. The U-shaped cleaning member holders have an integral stop shoulder 57 formed in the lower end thereof for holding the cleaning members or brushes 52 against axial movement in the housing of the washer 10.

As shown in FIGS. 4 and 5, the cleaning elements or brush bristles 54 for both of the brushes 52 are seated between a pair of vertically disposed and laterally spaced apart vertical retainer walls 59, which are integrally formed on the sloping inner surface 39 on the bottom wall 11, and which extend upwardly so that their upper ends are disposed adjacent the inner lower ends of the guide walls 60 and 63 when the cover 41 is mounted in the position shown in FIG. 5. The cleaning element or brush bristle support walls 59 are each supported at their lower ends by an integral support bracket 66 which is mounted integrally between the bottom end wall 11 and the lower end of each of the walls 59.

In use, a golf iron, generally indicated by the numeral 68 in FIG. 4, is vertically disposed with the blade 69 in a downward position, and it is then moved downwardly through the opening 51 and into cleaning engagement with the bristles 54 of the two brushes 52. The blade 69 may then be quickly and efficiently cleaned by moving the same rapidly upwardly and downwardly between the bristles 54. Experience has shown that the golf iron washer of the present invention functions to clean a golf iron in a quick, easy and efficient manner. It will be seen that the guide walls 60 through 63 help to guide a golf iron 68 downwardly into the washer 10, and the brushes 52 are held in position against vertical movement by the guide walls 62 and 63 and the retainer plates 65. No special tools are needed to replace the brushes 52. With the cover 41 released and removed, a used pair of brushes 52 may be quickly and easily removed by grasping the same and moving them upwardly and out of the washer housing. A new pair of brushes may then be inserted by dropping them straight downwardly until the ends of the brush heads 53 are seated in the U-shaped holders formed by the walls 56 and 58. It will be understood that the golf iron washer of the present invention may be made to any desired size. In one embodiment, the brush head 53 was three-quarter inches thick, eight inches long and two and one-half inches wide, and the bristles 54 comprised nylon bristles.

As an alternative cleaning element for each cleaning member, the bristles 54 may be replaced with a rough texture cleaning pad operatively attached to and carried by each carrier block 53. Such a rough texture cleaning pad may comprise a "TEFLON" (a trademark)(polytetrafluoroethylene) surfaced material wrapped around a foam rubber backing member which would be attached to a carrier head 53. A pair of the cleaning pads would be disposed in opposing positions in the same manner as the bristles 54.

While there has been shown and described a preferred embodiment of the invention, it is understood that various changes, omissions, and substitutions may be made by those skilled in the art.

INDUSTRIAL APPLICABILITY

The golf iron washer of the present invention is adapted for use at every tee on a golf course, or at any desired location along a fairway, or at a golf driving range.

I claim:

1. A golf iron washer characterized in that it includes:

(a) a rectangular housing including a horizontal bottom end wall, a pair of integral front and rear vertical walls, and a pair of integral side vertical walls, and being open at the upper end thereof;

(b) mounting means on the outer lower face of the bottom wall for mounting the housing on a support means;

(c) cleaning member support means in said housing for releasably supporting a pair of rectangularly shaped cleaning members disposed on their sides, with their cleaning elements extended toward each other in opposing relationship, and with their longitudinal axes disposed lengthwise of the front and rear vertical walls;

(d) a cover member releasably mounted on the upper open end of said housing and having an opening formed therethrough for the passage therethrough of a golf iron;

(e) a predetermined level of cleaning fluid in said housing; and, (f) said cover member being provided with inwardly extended integral front, rear and a pair of side guide walls which are integrally attached at their upper end to the cover member, and which have their lower ends in abutting engagement with the upper longitudinal sides of the cleaning members for releasably retaining them in said cleaning member support means, whereby when a golf iron is manually inserted head first through the opening in said cover member, the golf iron head is guided by the guide walls between said cleaning members, and continued manual reciprocating of the golf iron results in a washing of the golf iron head.

2. A golf iron washer as defined in claim 1, characterized in that:

(a) the housing is provided with a drain hole through one corner of the housing bottom wall which is normally closed by a removable drain plug; and, (b) the inner surface of said bottom wall slopes toward said drain hole.

3. A golf iron washer as defined in claim 2, characterized in that:

(a) a cushion pad is mounted on said sloping inner surface of the bottom wall.

4. A golf iron washer as defined in claim 2, characterized in that:

(a) one of the vertical housing walls is provided with an open drain hole for draining off excess fluid in the housing to maintain said predetermined level of fluid in the housing.

5. A golf iron washer as defined in claim 4, characterized in that:

(a) at least one of the housing walls is provided on the outer surface thereof with means for mounting an instruction plaque.

6. A golf iron washer as defined in claim 4, characterized in that:

(a) at least one of the housing walls is provided on the outer surface thereof with means for mounting advertising material.

7. A golf iron washer as defined in claim 4, characterized in that:

(a) said housing, cover member and mounting means are made from a resin plastic material.

8. A golf iron washer as defined in claim 4, characterized in that:

(a) one of the vertical housing walls is provided with an integral towel rack.

* * * * *